US005855690A

United States Patent [19]

Takahashi

[11] Patent Number: 5,855,690

[45] Date of Patent: Jan. 5, 1999

[54] METHOD OF EVAPORATION REMOVAL OF OILY SUBSTANCES FROM METALLIC ARTICLES

[75] Inventor: Susumu Takahashi, Yokohama, Japan

[73] Assignee: Kanto yakin Kogyo K.K., Japan

[21] Appl. No.: 766,062

[22] Filed: Dec. 16, 1996

[30] Foreign Application Priority Data

Dec. 19, 1995 [JP] Japan ..... 7-353398

[51] Int. Cl.[6] ..... B08B 7/00

[52] U.S. Cl. ..... 134/19; 134/10; 134/12; 134/21

[58] Field of Search ..... 134/13, 21, 37, 134/10, 12, 19; 432/1, 14, 21, 105, 159, 176; 266/44, 144, 152, 155, 156

[56] References Cited

U.S. PATENT DOCUMENTS 3,627,289 12/1971 Erman ..... 263/33 R

*Primary Examiner*—Jeffrey Stucker

*Attorney, Agent, or Firm*—Shlesinger, Fitzsimmons & Shlesinger

[57] ABSTRACT

Oily substances applied over metallic articles such as aluminum parts have to be removed before brazing them. Their removal is made by heating the parts in an inexplosive gas atmosphere in a heating chamber whereby the oily substances are evaporated into the gas atmosphere which is continuously circulated through a closed circuit consisted of said heating chamber and passage connecting a gas inlet and outlet of the heating chamber. The oily substances carried by the gas are removed from the gas in the passage.

5 Claims, 2 Drawing Sheets

METHOD OF EVAPORATION REMOVAL OF OILY SUBSTANCES FROM METALLIC ARTICLES

BACKGROUND OF THE INVENTION

In machine processing of metallic articles, an oily liquid or grease is applied over the articles in order to improve their machinability and also in order to prevent them from rusting. Such oily substances must be removed during machining or after machining has been completed.

This invention relates to a method for removing such oily substances from metallic articles, in which the substances are evaporated by heating the metallic articles so that the oily substances are removed from the metallic articles to such extent that such removal may not have trouble in further machining the articles.

Although oily substances of the kind mentioned above have been heretofore washed and removed by organic solvents such as tricholoroethylene, other removal methods have been sought, because the employment of such organic solvents is not desirable in view of environmental protection.

While oily substances have been heated so that they evaporate to air from metallic articles, other removal methods have been sought, because such evaporation to air damages working environment. There is also a risk that an oily gas removed from a metallic article by evaporation ignites and explodes.

It is therefore an object of this invention to provide a method by which oily substances can readily be removed without the employment of organic solvent and without a risk of explosion.

SUMMARY OF THE INVENTION

In this invention, metallic articles are heated in a heating atmosphere filled up by a nonflammable or inexplosive gas, so that oily substances coated over the articles are isolated by evaporation from the articles. Since a heating chamber in which metallic articles covered by oily substances are heated, is filled up by an inexplosive gas only, an oily gas evaporated from the metallic articles and isolated into the chamber shall not ignite and explode. It is a matter of course for carrying out this invention that when oily substances coated over articles are heated, they must readily evaporate and leave the articles at such temperature which does not injure the articles.

It is characteristic in this invention that those oily substances which are isolated into a heating atmosphere by the evaporation from metallic articles, are led outside of a heating chamber together with a part of the heating atmosphere, so that the oily substances can be collected and reused for heating the heating chamber, and the part of the heating atmosphere free from the oily substances can be recycled into the heating chamber. The oily substances led outside of the heating chamber with the part of the heating atmosphere may be burnt outside of the heating chamber, and a gas obtained thereby may be recycled into the heating chamber.

The atmosphere gas in the heating chamber is, as mentioned above a nonflammable or inexplosive gas such as described in Japanese Post-Examination Patent Publication No. 58-27323 in which a raw gas such as butane, propane and the like is burnt to heat a heating chamber and its exhaust gas is employed as a heating atmosphere gas. That is, such gas burnt in a closed radiant tube of a burner located within a heating chamber heats the heating chamber to a desired temperature, and its exhaust gas is recycled into the heating chamber as a nonflammable or inexplosive gas. In the Example 1, butane is burnt in an exothermic gas generating burner with air at a ratio of 1 (butane):26 (air). When its combustion exhaust gas is cooled and dehydrated, it scarcely contains an isolated oxygen, and only about 8% of carbon monoxide is contained therein. This kind of nonflammable and inexplosive gas is employable in this invention. In the Example 2, a combustion gas is burnt in a burner open to a heating chamber, and its exhaust gas is directly employed in a heating chamber as its atmosphere gas.

THE DRAWINGS

FIG. 1 is an explanatory side sectional view of a heating chamber and related gas supply system employed in Example 1 of this invention, and FIG. 2 is a view similar to FIG. 1, which illustrates a heating furnace and others employed in Example 2 of this invention.

DETAILED DESCRIPTION OF THE PREFERRED EMBODIMENTS

EXAMPLE 1

An automotive radiator made by the combination assembly of aluminum tubes and thin plates (of a weight of 1.4 Kg, and of dimensions of 600mm×400mm×36mm) was coated, for the purpose of machine processing and assembly, by a light oil lubricant, ignition point of which is 83° C. (COC), upper and lower explosing limits of which are assumedly 7 volume % and 0.6 volume %, and density of which is 0.79 g/cm2. Unless the lubricant which is an oily substance, is removed, abutments between the aluminum tubes and thin plates can not be brazed. Therefore, the oily substances were removed in accordance with this invention method, before the radiator was subjected to a brazing operation.

Figure 1:
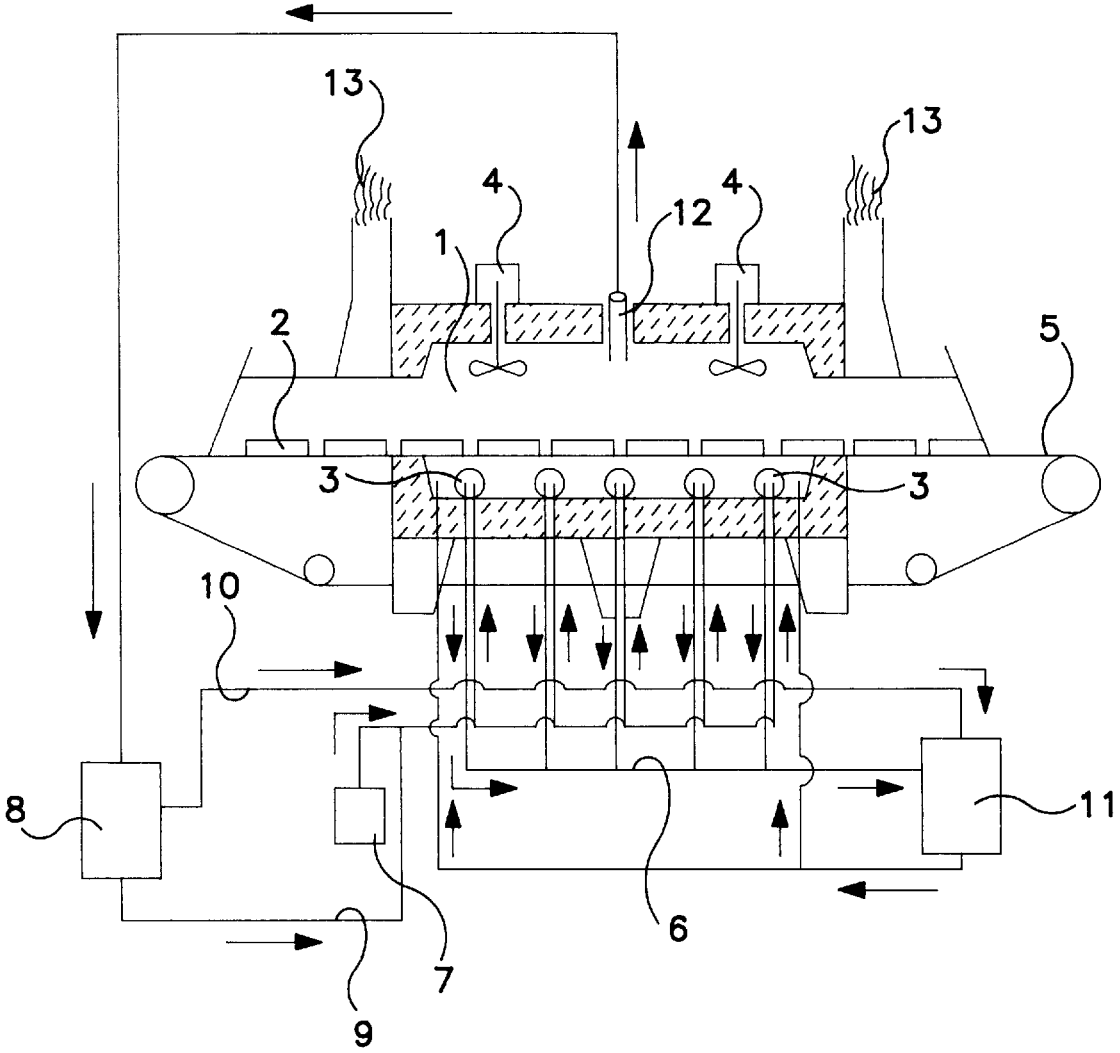

The method was carried out by means of a belt conveyor type continuous furnace which is illustrated in FIG. 1. In the drawing, numeral 1 indicates a tunnel-like heating chamber surrounded by heat-insulation materials. The chamber has at its both ends an inlet and outlet, and metallic mesh belt 5 circulating therethrough. The above-mentioned radiator assembly 2 was carried upon the belt and traveled through the heating chamber. The heating chamber was heated by a burner 3 which is as mentioned above for burning a fuel gas and for generating a reductive gas. The burning of the fuel gas is made in a plurality of closed radiant tubes for radiantly and indirectly heating the heating chamber. From a heat-source 7 to the burner 3, there was sent a propane gas mixed with air. The combustion of gas in the burner was controlled so that both of isolated oxygen and carbon monoxide remaining in a combustion exhaust gas were maintained as low as possible. The exhaust gas was sent through a pipe 6 to a refinery column 11 in which the gas was cooled and dehydrated. Thereafter, the gas which is neither flammable nor explosive, was recycled to the heating chamber as its heating atmosphere. Numeral 4 indicates agitators for making a chamber temperature even through the heating chamber.

The heating atmosphere in the heating chamber 1 which contains oily substances evaporated from the radiator assemblies, was partially led outside of the chamber through an exhaust tube 12, and to a gas and liquid separator 8. The liquidous oil substances separated by the separator 8 were returned through a pipe 9 and reused as a heat-source. On the other hand, the gas separated by the separator was recycled through a pipe 10 to the refinery column 11 through which it was sent to the heating chamber as its atmosphere. Numerals 13 indicate pilot flames for safely burning out flammable substances which are contained in a gas dissipated about the inlet and outlet of the heating chamber.

The atmosphere within the heating chamber 1 was kept at 180° C., and the radiator assemblies 2 were passed therethrough in 15 minutes, whereby oily substances of 66 g were removed per each assemblies. These radiator assemblies, oily substances of which had been removed, were subjected to a separate brazing operation. The brazing was made satisfactorily.

EXAMPLE 2

Figure 2:
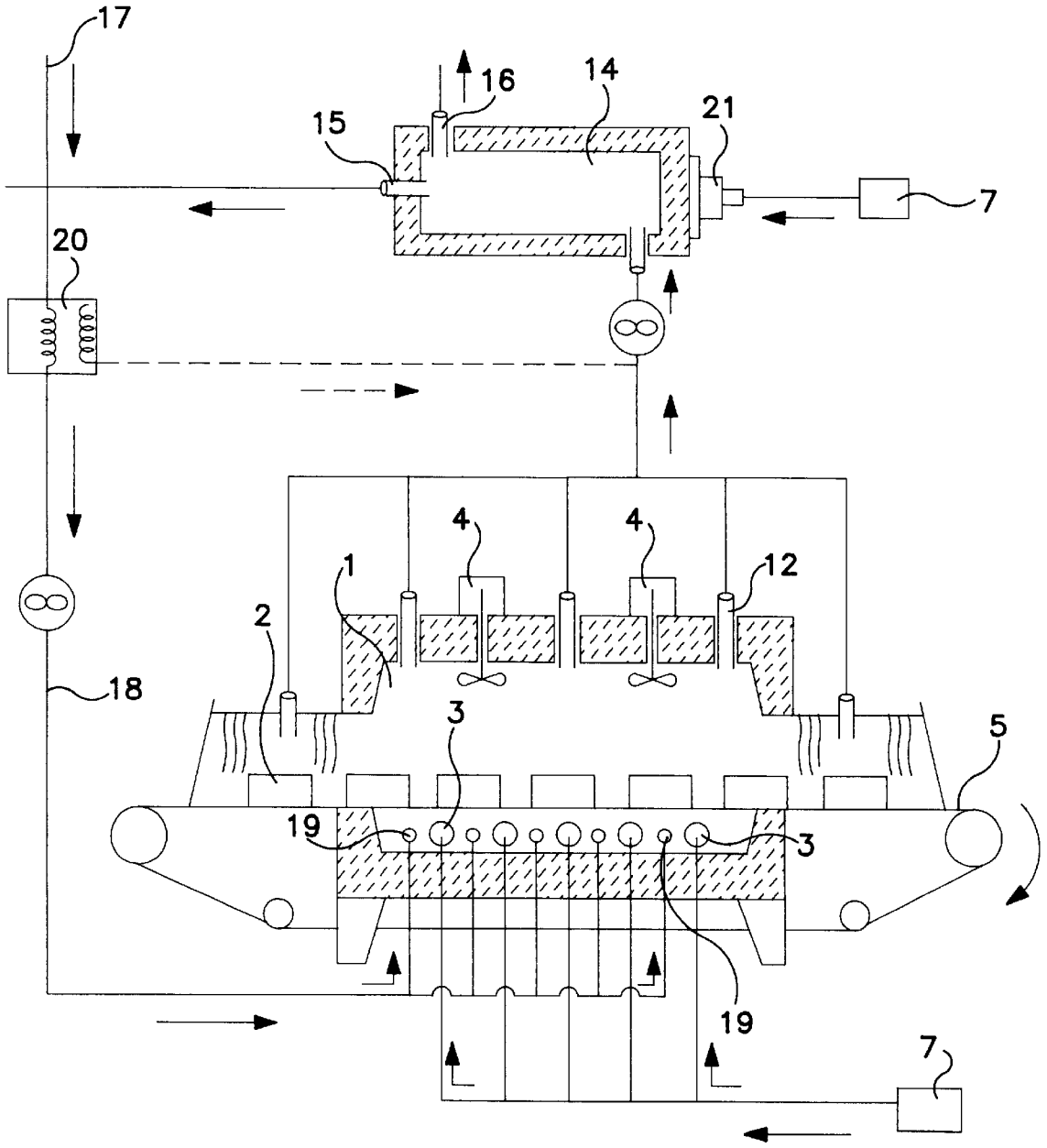

In FIG. 2 in which the parts same to those illustrated in FIG. 1 are represented by same numerals, burners 3 in this Example 2 are however not of closed radiant types but are open to the heating chamber 1. Accordingly, combustion exhaust gas which has been produced by the burners 3 by burning a combination gas of air and propane sent from heat-source 7 is released to the heating chamber to make a heating atmosphere together with another gas released to the chamber through pipe openings 19 which will be described below more in detail. The heating atmosphere which is kept at 180° C. and through which the above-mentioned automotive radiator assemblies are passed, heats them and evaporates oily substances from them. And, the heating atmosphere which thus contains the oily substances, are led via an exhaust fan to a combustion chamber 14 in which a combination gas of propane and air sent from the heat source 7 is burnt by a burner 21 to about 400° to 700° C. Into this burning gas, there is sent the above-mentioned heating atmosphere, whereby its oily substances are burnt out. A part of the combustion exhaust gas thus produced in the combustion chamber 14 is released to air by an opening 16 in order to keep a pressure in the combustion chamber constant, and its major part is led through an opening 15 and a pipe 18 to the above-mentioned pipe openings 19 so that it is reused as the heating atmosphere. Before returning to the heating chamber the combustion exhaust gas which has been heated to 400° to 700° C., it has to be cooled down to about 180° C. which is a working temperature of the heating chamber 1.

The exhaust gas is cooled down by sucking into the gas from a pipe 17 an atmospheric air of room temperature at such amount that when it is recycled into the heating chamber, a density of oily substances contained in the heating atmosphere in the chamber as a whole shall not exceed its low explosion limit of 0.6%. In fact, the density was kept about 0.06% in this Example.

Or, alternatively, the gas is cooled by a heat exchanger 20, cooling medium of which is an atmospheric air of room temperature. The air cooling medium which has been heated up, can be utilized as an air additive in the combustion chamber 14.

In this Example 2 too, oily substances were satisfactorily removed, and the automotive radiator assemblies were brazed well.

I claim:

1. Method of removing from metallic articles oily substances adhered on the articles, which comprises providing a heating chamber having therein burners for heating said chamber, while causing said heaters to heat said chamber and the articles under an inexplosive gas so that the oily substances evaporate from the articles into the inexplosive gas, leading the evaporated substances with the gas outside the heating chamber and removing the evaporated substances from the gas lowering the temperature of the gas and returning to the heating chamber the gas, from which the evaporated substances have been removed.

2. Method as claimed in claim 1, in which the oily substances which have been removed from the gas, are fed to said burners and are employed thereby to heat the heating chamber.

3. Method as claimed in claim 1, in which the evaporated substances are removed from the gas by burning the substances and gas outside the heating chamber.

4. Method as claimed in claim 1, in which a temperature of the gas is lowered by contacting the gas indirectly with a cooling medium.

5. Method as claimed in claim 1, in which a temperature of the gas is lowered by adding to the gas an air at such density, under which the gas is inexplosive.

* * * * *